United States Patent [19]

Thibault

[11] Patent Number: 4,695,147

[45] Date of Patent: Sep. 22, 1987

[54] APPARATUS AND METHOD FOR PREVENTING THE FORMATION OF A DEPOSIT FROM A PROCESSING SOLUTION ON A FILM TRANSPORT MEMBER

[75] Inventor: Jean Thibault, Chalon sur Saone, France

[73] Assignee: Eastman Kodak Company, Rochester, N.Y.

[21] Appl. No.: 916,593

[22] Filed: Oct. 8, 1986

[30] Foreign Application Priority Data

Dec. 23, 1985 [FR] France ..... 85 19016

[51] Int. Cl.[4] ..... G03D 3/08

[52] U.S. Cl. ..... 354/322; 226/189; 134/64 P

[58] Field of Search ..... 354/316, 320, 321, 322, 354/298; 226/189, 188; 134/64 P, 122 P

[56] References Cited

U.S. PATENT DOCUMENTS

| | | | |
|---|---|---|---|
| 2,048,182 | 7/1936 | Ybarrondo | 354/322 |
| 3,116,677 | 1/1964 | Wetzel | 354/321 |
| 3,699,869 | 10/1972 | Jensen | 354/321 |
| 4,423,947 | 1/1984 | Jelinek et al. | 354/320 |

FOREIGN PATENT DOCUMENTS

| | | |
|---|---|---|
| 0004337 | 10/1979 | European Pat. Off. . |
| 916170 | 1/1963 | United Kingdom . |

*Primary Examiner*—A. A. Mathews

*Attorney, Agent, or Firm*—Roger A. Fields

[57] ABSTRACT

In a roller transport assembly of a film processor, respective cross-over rollers for transferring the exposed film from one tank of processing solution to an adjacent tank of processing solution are positioned above the free surfaces of the solutions during normal operation. However, the cross-over rollers are immersed in the solutions during non-operation of the processor to prevent the residue of solution on the roller surfaces from oxidizing to form a viscous or solid deposit.

12 Claims, 2 Drawing Figures

APPARATUS AND METHOD FOR PREVENTING THE FORMATION OF A DEPOSIT FROM A PROCESSING SOLUTION ON A FILM TRANSPORT MEMBER

BACKGROUND OF THE INVENTION

1. Field of the Invention

The invention relates generally to the field of film processing. More particularly, the invention relates to an apparatus and a method for preventing the formation of a viscous or solid deposit from a processing solution on a film transport member in a film processor.

2. Description of the Prior Art

One well known version of apparatus for processing exposed film to convert its latent images to visible ones includes a plurality of tanks each of which contains a different film processing liquid, such as a developer solution, a fixer solution, and a wash solution. The tanks are disposed in successive adjacent relation in order that the exposed film may be advanced from tank to tank and successively treated by the different processing solutions. To effect such film advance, the processing apparatus further includes several groupings of vertically disposed rollers which are respectively immersed in the different processing solutions within the tanks to move the exposed film through such solutions. Other rollers are located above the tanks, proximate the boundaries between the tanks, to move the exposed film from tank to tank. Together these rollers define a sinuous film advance path which interconnects the tanks. When all of the rollers are driven approximately at the same speed, the exposed film is moved along the sinuous path through the tanks and is successively immersed in the different processing solutions.

The upper rollers located above the tanks, proximate the boundaries between the tanks, are commonly referred to as "cross-over rollers" in view of their function to transfer the exposed film from tank to tank. As the exposed film is advanced from a processing solution and over a cross-over roller, there is a tendency to transfer droplets of the solution from the wet film to the roller surface. This usually does not present a problem as long as the cross-over rollers are continuously wetted by the exposed film. However, when the processing apparatus is left idle for a while, the droplets of solution on the cross-over rollers oxidize to form viscous or solid deposits on the roller surfaces. These deposits, unless removed for example by rinsing or washing the cross-over rollers, are abrasive and contaminating to the exposed film and the roller components. Thus, the deposits may damage the exposed film and may cause a premature wearing of the cross-over rollers.

SUMMARY OF THE INVENTION

The invention provides an improved apparatus and method for preventing the formation of a viscous or solid deposit from a processing solution on a film transport member, such as a cross-over roller.

According to the invention, the film transport member is moved from an operative position above the free surface of a volume of processing solution to a non-operative position immersed in the processing solution below its free surface, generally during non-use of the transport member. This prevents the residue of solution on the transport member from oxidizing to form a viscous or solid deposit as in prior art devices.

DESCRIPTION OF THE PREFERRED EMBODIMENT

Figure 1:
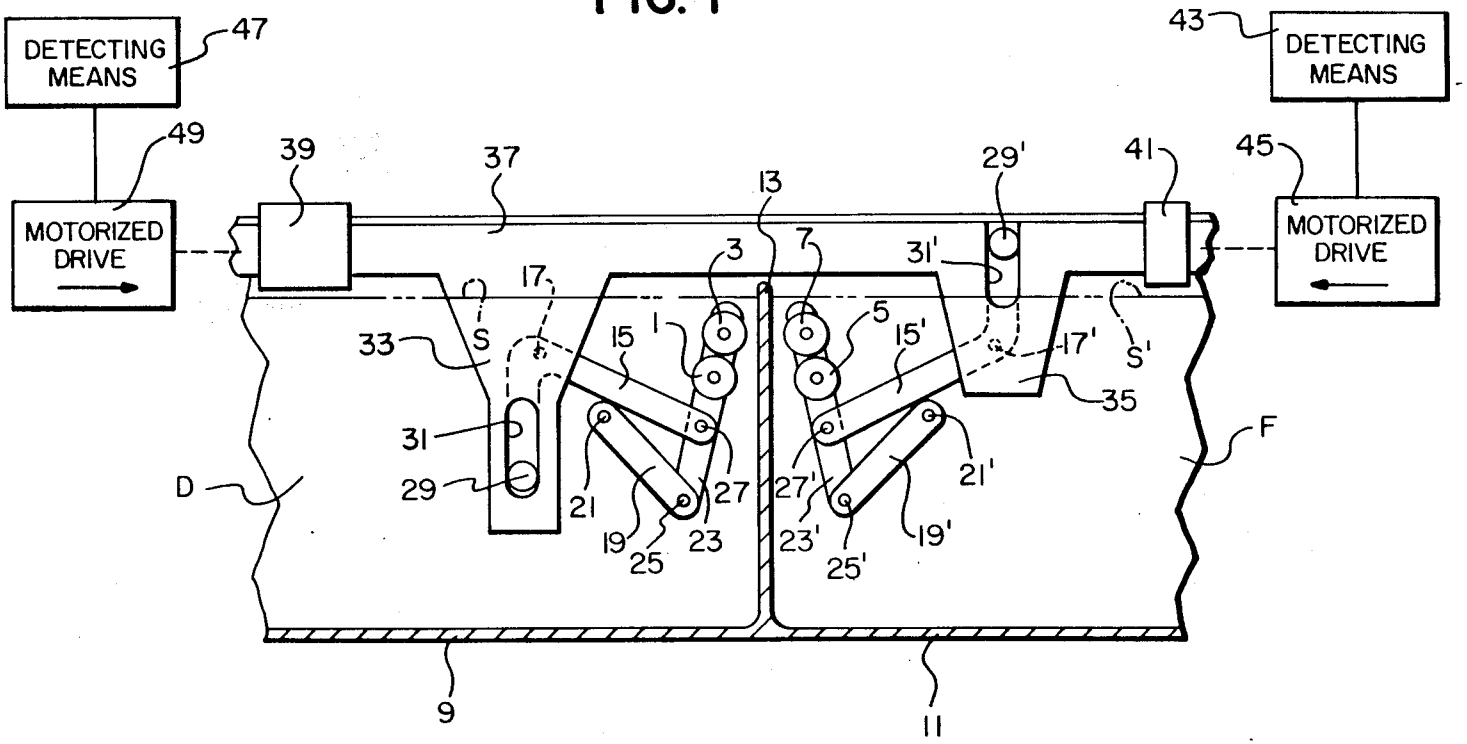
FIG. 1 is an elevation view of an elongate section of a film processor according to a preferred embodiment of the invention, illustrating the relative positions occupied by various mechanical members of the processor when the processor is in a non-operating mode.
Figure 2:
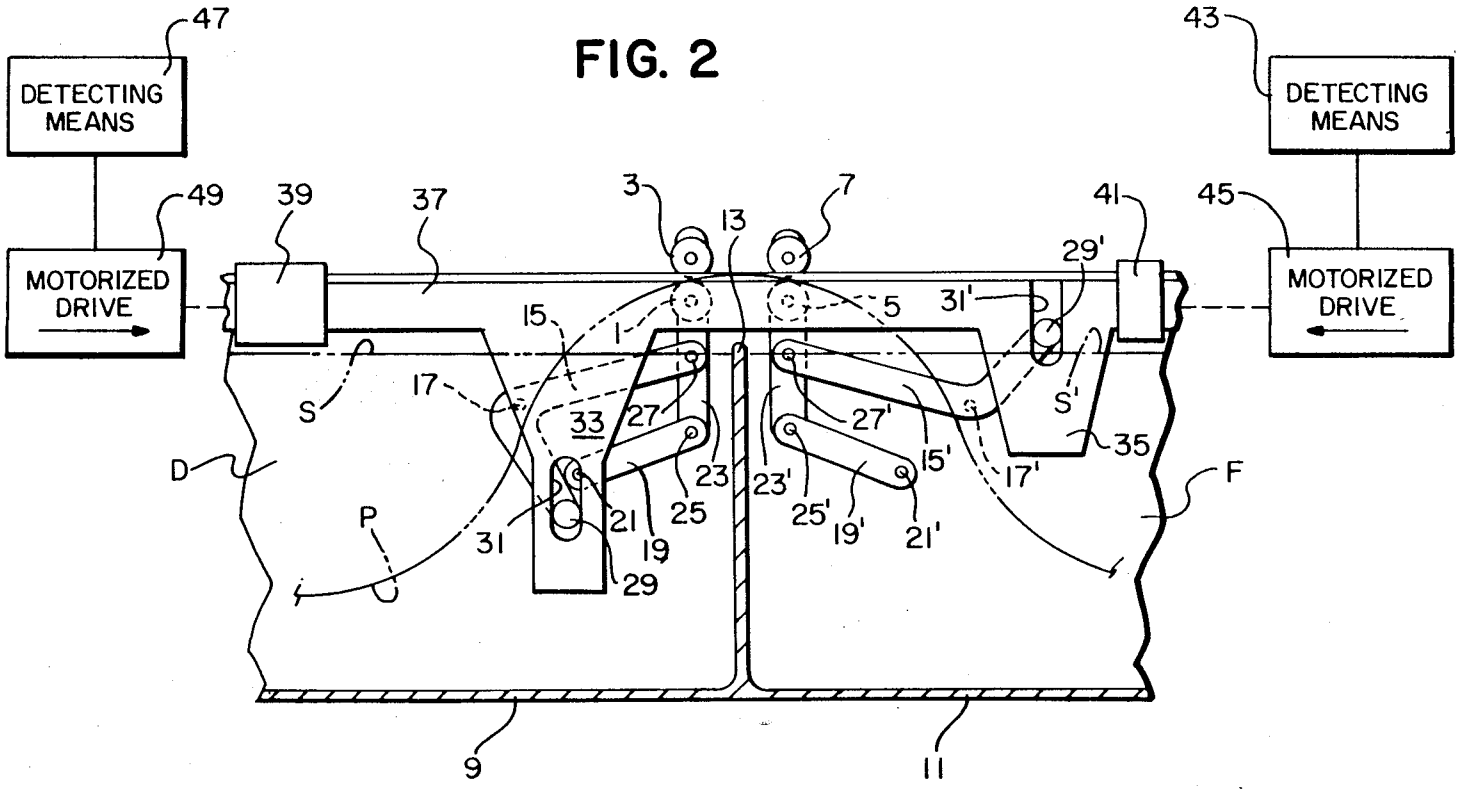
FIG. 2 is an elevation view similar to FIG. 1, illustrating the relative positions of the mechanical members when the film processor is in an operating mode.

Reference is made to FIGS. 1 and 2 of the drawings in which there is schematically depicted a preferred embodiment of the invention, as for example, to be incorporated in a low volume X-ray film processor such as the KODAK X-OMAT PROCESSOR ME-10.

The apparatus according to the invention includes film transport means having pairs of detachable cross-over rollers 1, 3 and 5, 7 which serve to guide and transport an exposed X-ray film between successive tanks 9 and 11 respectively containing a conventional developer solution D and a conventional fixer solution F. Another tank, not shown, contains a conventional wash solution. The developer and fixer solutions D and F are susceptive to atmospheric oxidation, especially when they are spread in a thin layer on the peripheral surfaces of the pairs of cross-over rollers 1, 3 and 5, 7 and the rollers are located above the free surfaces S and S' of the solutions in the tanks 9 and 11, as shown in FIG. 2.

The pairs of cross-over rollers 1, 3 and 5, 7 define a portion of a film path P followed by the X-ray film as it is transported from the left to the right in FIG. 2 from the developer solution D in the tank 9, above a partition 13 between the tank 9 and the tank 11, and into the fixer solution F in the tank 11. The cross-over rollers 1, 3 and 5, 7 of each pair are disposed in parallel relation and they define a nip through which the X-ray film is moved from one tank to the other tank. One of rollers of each pair is rotatably driven by suitable motorized means, not shown, and a driving motion is transmitted to the other roller of the pair by the meshing of two gears, not shown, located at both ends or at either end of the rollers. The nip between the rollers of each pair can have a variable width depending on the thickness of the X-ray film to be transported.

It is obvious in FIG. 2 that the pairs of cross-over rollers 1, 3 and 5, 7 are wetted by the developer solution D carried on both sides of the X-ray film which has exited from the tank 9 aling the film path P. The thin layer of developer solution which is deposited by the X-ray film on the peripheral surfaces of the rollers is submitted to evaporation and to a particularly rapid atmospheric oxidation. However, this phenomenon is moderated, in large volume processors, by a fast renewal of the thin layer of developer solution on the roller surfaces due to frequent passages of the X-ray film over the roller surfaces. On the other hand, in low volume processors which are used intermittently several hours can elapse between the passage of X-ray film over the roller surfaces. The evaporation and oxidation of the thin layer of developer solution on the roller surfaces can therefore be complete (or at least partial). The result is the formation of solid or viscous deposits on the roller surfaces of chemical compounds, e.g. crystallized. Such deposits are very detrimental to the quality of the X-ray film treated in the processor, as well as to the operation of the mechanical elements associated with the cross-over rollers.

According to the invention, the formation of such deposits on the pairs of cross-over rollers 1, 3 and 5, 7 is prevented by immersing the rollers in the developer and fixer solutions D and F in the tanks 9 and 11 generally during non-use of the rollers, as shown in FIG. 1. This immersion is done because it has been determined that when the cross-over rollers remain inactive above the free surfaces S and S' of the solutions, a risk of formation of the deposits on the roller surfaces results. Immersion of the cross-over rollers protects them by the wetness of the solutions against any evaporation of oxidation and the roller surfaces therefore remain free of any deposits.

As shown in FIGS. 1 and 2, the pairs of cross-over rollers 1, 3 and 5, 7 are associated at both ends or at either end with supporting mechanisms respectively comprising a bell cranks 15 and 15' pivotally supported by movable pins 17 and 17', small rods 19 and 19' pivotally supported by fixed pins 21 and 21', and arms 23 and 23' which each carry a pair of the cross-over rollers. The arms 23 and 23' are pivotally supported by movable pins 25 and 25' and by movable pins 27 and 27' at ends of the bell cranks 15 and 15' and the small rods 19 and 19' which are adjacent the arms. This causes the arms 23 and 23' to be arranged substantially vertically relative to the free surfaces S and S' of the developer and fixer solutions D and F in the tanks 9 and 11. The ends of the bell cranks 15 and 15' which are opposite the ones that are pivotally connected to the arms 23 and 23' have lugs 29 and 29' that slide in slots 31 and 31'. The slots 31 and 31' have substantially vertical axes. Alternatively, each lug and slot may be replaced by a pin and groove or other suitable coupling.

As shown in FIGS. 1 and 2, the slots 31 and 31' are cut out of respective protrusions 33 and 35 which depend from a single control slider 37. The control slider 37 is horizontally movable in bearings 39 and 41 for simultaneously moving the bell cranks 15 and 15', the small rods 19 and 19', and the arms 23 and 23' between a raised position in FIG. 2, in which the pairs of cross-over rollers 1, 3 and 5, 7 are located above the free surfaces S and S' of the developer and fixer solutions D and F, and a lowered position in FIG. 1, in which the cross-over rollers are entirely immersed in the developer and fixer solutions. According to the invention, the cross-over rollers are immersed during the time that the film processor is not operating. Thus, the cross-over rollers are sheltered from air and no evaporation or oxidation of the solutions is possible to create solid or viscous deposits on the roller surfaces.

When the control slider 37 is moved to the right in FIG. 1, the bell cranks 15 and 15' move the pairs of cross-over rollers 1, 3 and 5, 7 above the free surfaces S and S' of the developer and fixer solutions D and F. See FIG. 2. FIG. 2 shows the operative positions of the cross-over rollers. When the control slider is moved to the left in FIG. 2, the cross-over rollers are lowered below the free surfaces of the developer and fixer solutions. See FIG. 1. FIG. 1 shows the non-operative positions of the cross-over rollers.

The movement of the control slider 37 to the right or left to elevate or immerse the pairs of cross-over rollers 1, 3 and 5, 7 can be manual or automatic. When movement of the control slider 37 to the left is automatic, the immersion of the cross-over rollers may be actuated a short time after the film processor has been idle. This condition can be detected by means of a known control circuit comprising a film detecting means 43 which includes a sensor for detecting the absence of X-ray film in the processor or for detecting the trailing end of the X-ray film and a time limiting device. A motorized drive 45 energized by the detecting means 43 detecting the absence of X-ray film for a predetermined time would drive the slider 37 to the left. To move the slider 37 automatically to the right to elevate the pairs of cross-over rollers 1, 3 and 5, 7, another film detecting means 47 includes a sensor for detecting the introduction of X-ray film in the processor or for detecting the leading end of the X-ray film. A motorized drive 49 energized by the detecting means 47 detecting the presence of X-ray film would drive the slider 37 to the right. Of course, a single detecting means and a bi-directional motor drive can be used to move the slider 37 automatically to the left and to the right.

The immersion of the pairs of cross-over roller 1, 3 and 5, 7 in the developer and fixer solutions D and F causes a rise of the free surfaces S and S' of the solutions. It may be desirable to correct this in order to avoid any overflow of the solutions. The correction may be accomplished by providing overflow pipes for the tanks 9 and 11 or by providing other known devices for maintaining a constant level of solution.

The invention has been described with reference to a preferred embodiment. However, it will be appreciated that variations and modifications can be effected within the ordinary skill in the art without departing from the scope of the invention. For example, any film material be it strip film, film sheets or film plates may be used with the invention. Likewise, the cross-over rollers may be immersed by raising the free surfaces of the developer and fixer solutions.

I claim:

1. An improved photographic processing apparatus of the type wherein transport means is operated to transport a photosensitive material along a predetermined path through a free surface of a volume of processing solution, and wherein the improvement comprises:

means for moving said transport means to an operative position elevated at least partially above the free surface of the processing solution, to enable said transport means to be operated to transport the photosensitive material along the predetermined path through the free surface of the processing solution, and to a non-operative position immersed in the processing solution below its free surface, to prevent the formation of a deposit from the solution on said transport means generally during non-use of the transport means.

2. An improved photographic processing apparatus of the type wherein first and second transport means are operated to transport a photosensitive material along a predetermined path from a free surface of a volume of one processing solution to a free surface of a volume of another processing solution, and wherein the improvement comprises:

means for moving said first and second transport means to individual operative positions elevated at least partially above the free surfaces of the respective processing solutions, to enable said first and second transport means to be operated to transport the photosensitive material along the predetermined path from the free surface of the one processing solution to the free surface of the other processing solution, and to individual non-operative positions immersed in the respective processing solutions below their free surfaces, to prevent the formation of deposits from the respective solutions on said first and second transport means generally during non-use of the first and second transport means.

3. The improvement as recited in claim 2, wherein said first and second transport means include respective pairs of adjacent cross-over rollers defining nips through which the predetermined path extends whenever the first and second transport means are in their individual operative positions.

4. The improvement as recited in claim 2, wherein said moving means is adapted to move said first and second transport means simultaneously to their individual operative positions and simultaneously to their individual non-operative positions.

5. The improvement as recited in claim 4, wherein said moving means includes a single control member coupled to said first and second transport means, said control member being supported for movement in one direction to move said first and second transport means simultaneously to their individual operative positions and for movement in another direction to move the first and second transport means simultaneously to their individual non-operative positions.

6. The improvement as recited in claim 5, wherein said moving means includes detection means responsive to detecting the presence of the photosensitive material for moving said single control member in the one direction and responsive to detecting the absence of the photosensitive material for moving said single control member in the other direction.

7. An improved photographic processing apparatus of the type wherein respective cross-over means are positioned above the free surfaces of adjacent volumes of processing solutions to transfer a photosensitive material from one of the volumes to the other volume, and wherein the improvement comprises:

means for immersing said respective cross-over means beneath the free surfaces of the volumes of processing solutions generally during non-use of the respective cross-over means, to prevent the formation of deposits from the solutions on said respective cross-over means.

8. The improvement as recited in claim 7, wherein said immersing means is adapted to immerse said respective cross-over means simultaneously.

9. An improved photographic processing method of the type wherein transport means is operated to transport a photosensitive material along a predetermined path through a free surface of a volume of processing solution, and wherein the improvement comprises:

moving said transport means to an operative position elevated at least partially above the free surface of the processing solution, to enable said transport means to be operated to transport the photosensitive material along the predetermined path through the free surface of the processing solution, and to a non-operative position immersed in the processing solution below its free surface, to prevent the formation of a deposit from the solution on said transport means generally during non-use of the transport means.

10. An improved photographic processing method of the type wherein first and second transport means are operated to transport a photosensitive material along a predetermined path from a free surface of a volume of one processing solution to a free surface of a volume of another processing solution, and wherein the improvement comprises:

moving said first and second transport means to individual operative positions elevated at least partially above the free surfaces of the respective processing solutions, to enable said first and second transport means to be operated to transport the photosensitive material along the predetermined path from the free surface of the one processing solution to the free surface of the other processing solution, and to individual non-operative positions immersed in the respective processing solutions below their free surfaces, to prevent the formation of deposits from the respective solutions on said first and second transport means generally during non-use of the first and second transport means.

11. The improvement as recited in claim 10, wherein said first and second transport means are moved to their individual operative positions simultaneously and are moved to their individual non-operative positions simultaneously.

12. An improved photographic processing method of the type wherein respective cross-over means are positioned above the free surfaces of adjacent volumes of processing solutions to transfer a photosensitive material from one of the volumes to the other volume, and wherein the improvement comprises:

immersing said respective cross-over means beneath the free surfaces of the volumes of processing solutions generally during non-use of the respective cross-over means, to prevent the formation of deposits from the solutions on said respective cross-over means.

* * * * *